US005127816A

United States Patent [19]

Grolla

[11] Patent Number: 5,127,816

[45] Date of Patent: Jul. 7, 1992

[54] MOLDING MACHINE

[75] Inventor: Herbert Grolla, Bad Laasphe, Fed. Rep. of Germany

[73] Assignee: Heinrich Wagner Sinto Maschinenfabrik GmbH, Bad Laasphe, Fed. Rep. of Germany

[21] Appl. No.: 549,315

[22] Filed: Jul. 6, 1990

[51] Int. Cl.[5] ..... B29C 43/08; B28B 7/10

[52] U.S. Cl. ..... 425/361; 425/421; 425/422; 425/432; 425/434; 425/444; 425/454

[58] Field of Search ..... 425/453, 454, 441, 434, 425/435, 429, 430, 432, 357, 358, 359, 361, 421, 422, 444

[56] References Cited

U.S. PATENT DOCUMENTS

| | | | |
|---|---|---|---|
| 3,577,610 | 4/1968 | Margolin | 425/454 |
| 3,625,535 | 11/1971 | Ringdell | 425/453 |
| 3,764,242 | 10/1973 | Fischer | 425/432 |
| 3,767,351 | 10/1973 | Blaser | 425/432 |
| 3,868,209 | 2/1975 | Howell | 425/453 |
| 4,699,584 | 10/1987 | Kurita et al. | 425/454 |

FOREIGN PATENT DOCUMENTS

| | | | |
|---|---|---|---|
| 548756 | 3/1932 | Fed. Rep. of Germany . | |
| 1058701 | 6/1959 | Fed. Rep. of Germany . | |
| 2513072 | 10/1975 | Fed. Rep. of Germany | 425/453 |
| 2721874C2 | 11/1978 | Fed. Rep. of Germany . | |
| 3010652C2 | 9/1981 | Fed. Rep. of Germany . | |
| 56-70920 | 6/1981 | Japan | 425/453 |
| 1158362 | 5/1985 | U.S.S.R. | 425/453 |

*Primary Examiner*—Jay H. Woo
*Assistant Examiner*—Khanh P. Nguyen
*Attorney, Agent, or Firm*—Flynn, Thiel, Boutell & Tanis

[57] ABSTRACT

A molding machine which includes a rotary-table system having at least two tables supported on the frame, which system has a lifting device in the area of each table, and a compressing device constructed on the frame.

10 Claims, 2 Drawing Sheets

MOLDING MACHINE

FIELD OF THE INVENTION

The invention relates to a molding machine comprising a frame, a compressing device and at least one lifting device.

BACKGROUND OF THE INVENTION

To manufacture molds, foundries often use separate machines for filling a molding box, to compress the molding material and to lift off the mold. It is thereby known to have the compressing operation and the lifting-off operation done by a machine to which is fed a filled molding box resting on a pattern plate.

It is necessary in the known molding machines to successively manually carry out a number of individual operations or, when using partially automated machines, to manually monitor those operations. The operations necessary for the manufacture of a mold include the mounting of a molding box on a pattern plate and the mounting of a sand frame on the molding box. These two operations are usually done manually. Sand is subsequently filled into the molding box through the sand frame. This is usually done by means of a manually operable conveying device. After sufficient amounts of sand have been filled in, a pre-compressing of the sand in the mold takes place usually using vibrators for this purpose. After a counter-pressing plate is swung in, the molding sand is further compressed during a pressing operation. It is thereafter necessary to remove the pressing plate from the molding box in order to subsequently separate the mold from the pattern or rather from the pattern plate by means of a lifting device. These operations require a number of manual handlings and therefore cannot or only with a considerable expense be further rationalized and/or automated in known molding machines.

A further disadvantage of the known molding machines or rather of the methods used in the machines is that the upper box mold and the lower box mold are manufactured on separate molding machines. This has the disadvantage that on the one hand the manufacturing times for a mold ready to be cast are very high and on the other hand both the coordination of the method of operation of the two molding machines and also the coordination of the transport operations bring about a significant expense.

The known molding machines are disadvantageous also with respect to the compressing method, which they use, since in particular in the case of smaller molding machines a pre-compressing of the mold through shaking is done, which on the one hand results in a high amount of wear to both the molding machines and also to the molding boxes and patterns.

The basic purpose of the invention is to provide a molding machine of the above-mentioned type, which with a simple design and simple, reliable handling enables an economical and time-saving manufacture of a mold ready for casting.

The purpose is attained according to the invention by a rotary-table system including at least two tables being supported on the frame, which rotary-table system has in the area of each table a lifting device, and by the compressing device being designed as a frame.

The molding machine of the invention has a number of significant advantages. The rotary-table system including several tables makes it possible to have predetermined operations take place independently from one another on each of the tables. Thus, it is for example possible to compress the molding sand at one of the tables, while at the other table molding sand is being filled in or a finished mold is lifted off. Using two tables makes it furthermore possible to produce on each table either one upper-box mold or one lower-box mold so that one complete mold ready for casting can be manufactured on one molding machine. Because of the possibility of operating the machine of the invention with only one operator, significant savings can be obtained not only with respect to the work force but also with respect to the costs of transport, since only the finished casting molds need be transported away from the molding machine of the invention, while the state of the art needed to use at least two individual molding machines each with an operator and the association of the upper-box molds and the lower-box molds for the construction of a finished casting mold had to be carried out by a third worker.

A further advantage of the molding machine of the invention is that the operator can work without time interruption because, in contrast to the molding machines known from the state of the art, during the compressing operation, other operations can be carried out on the other table.

A further advantage of the molding machine of the invention is that same is independent from the method used for compressing the molding sand or molding material so that it is possible both to compress the molding sand in a conventional manner by shaking and also by means of an air-flow press molding method.

A further, advantageous development of the invention provides that the rotary-table system includes in the area of each of the tables a support device for a molding box. The forces applied during compressing of the molding sand or of the molding material are directly transferred onto the frame by the support device, the rotary-table system itself is thereby not loaded. This opens up the possibility of making the rotary-table system substantially smaller.

The support system has preferably a support piston supported below the table and able to bear against the frame, and a lifting piston moving the table against the compressing device arranged in the upper area of the frame. The compressing operation includes thus both a supporting of the molding box or rather of the table on the frame and also a lifting of the molding box or rather of the table toward the compressing device arranged in the upper area of the frame. This development has the possibility of carrying out, in addition to the already mentioned reduction of support forces on the rotary-table system, a space-saving design of the molding machine and to provide a sufficient free space in particular in the area in which the table or rather the rotary-table system is swung toward the frame. Furthermore, it is not necessary, because of the lifting of the table, to lower the compressing device itself or to move it toward the molding box. Instead it is possible to mount the compressing device substantially stationarily on the upper area of the frame.

In order to guarantee both a support of the respective table and also a lifting of the table in direction of the compressing system in a simple and reliable manner, a particularly advantageous further development of the invention can provide that the support piston includes a pipe-shaped lifting cylinder movable with respect to the table in which is arranged the lifting piston designed in the form of a double-acting piston. The piston rod of the lifting piston is thereby connected to the table. It is now necessary in this design to apply by means of a hydraulic connection the respective side of the lifting piston with pressureized oil in order to accomplish simultaneously both a support of the support piston and also a lifting of the table. A separate control is thus not necessary.

In order to prevent an unintentional rotation of the table during its lifting in direction of the compressing device, it can be advantageous when the table is connected to a table guide rod which is movable in a recess of the rotary-table system.

The lifting device is designed preferably according to the invention in such a manner that a lifting cylinder is supported in the area of the table on the rotary-table system, the piston rod of which lifting cylinder is connected to lifting pins through a lifting traverse connected to the piston rod. Thus, each table of the rotary-table system has a separate lifting device so that it is not necessary to provide additional separate machines which would possibly have to be adjusted also in addition in their position with respect to the table.

Lifting guide rods are preferably supported on the lifting traverse, at the free ends of each rod is fastened one support which carries the lifting pin. This design has the advantage that an adjustment to different molding boxes or molding-box sizes can be carried out very quickly and simply. It is thereby also possible according to the invention to work molding boxes of different sizes on the rotary-table system.

The frame is in a further particularly favorable development designed substantially C-shaped in the side view. The rotary-table system is thereby pivotal about a vertical axis, with the pivot axis being arranged on the outer area of the C-shaped frame so that a table of the rotary-table system can be swung into the free space of the frame. This embodiment permits both a compact design of the molding machine and also a design of particular strength since the C-shaped frame experiences an additional support through the vertical axis of the rotary-table system.

A filling station, a lifting station and/or an auxiliary compressing station can be arranged on the outer area of the frame in order to lift off the finished mold in the area of the table which is not under the compressing device arranged on the frame, to mount a new molding box, to arrange a sand frame on the molding box, to supply and pre-compress sand.

The compressing device is designed such, in a preferred exemplary embodiment of the molding machine of the invention, that same includes a pressing plate which is movably arranged inside of a pressing box pressurizable with pressure air. Thus, it is possible to utilize an air-flow press molding method in which a vibrating of the molding box is not necessary. A further development of this embodiment can provide that the pressing plate is connected to a double-acting pressing piston and a guide rod guided in the frame. The embodiment guarantees both an exact guiding of the pressing plate and also a simple hydraulic control capability.

However, it is also possible according to the invention to use a compressing device in the form of a shaking device operating according to the shaking pressure compressing method.

BRIEF DESCRIPTION OF THE DRAWINGS

The invention will be described hereinafter in connection with one exemplary embodiment and the drawings, in which.

DETAILED DESCRIPTION

The molding machine of the invention has a frame 1 which has a substantially C-shaped cross section. The free ends of the C-shaped frame 1 are connected through a vertical axle 36 fixedly supported on the frame 1 and which carries a rotary-table system 3 pivotal about the axis A.

The rotary-table system 3 has two tables 9, each supported on the upper side of the rotary-table system 3.

Figure 1:
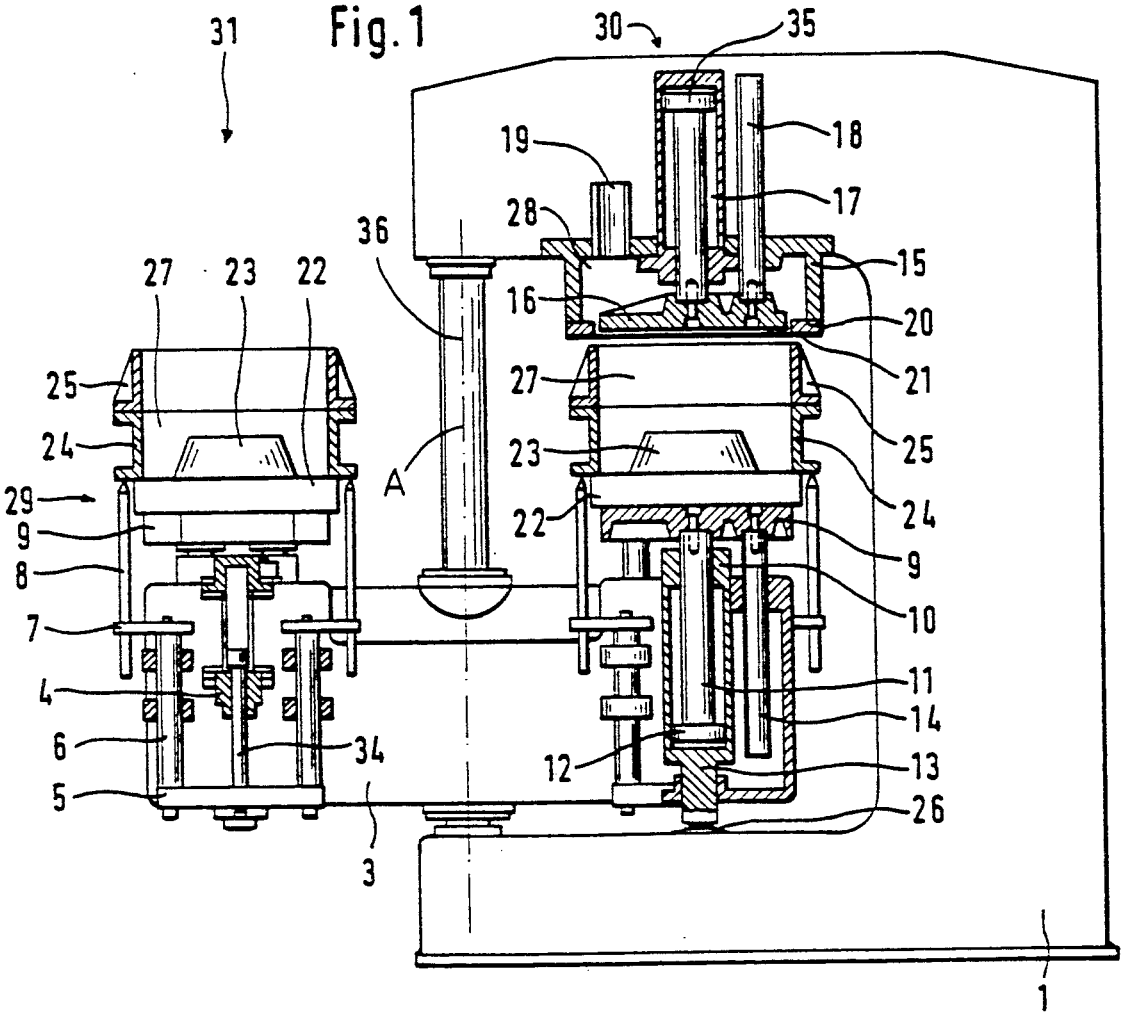
FIG. 1 is a schematic partially cross-sectional side view of one exemplary embodiment of the molding machine of the invention.

A pattern plate 22 can be placed onto each one of the tables 9, which pattern plate 22 has a pattern 23 in the usual manner. FIG. 1 shows that a molding box 24 can be placed onto the pattern plate 22, which molding box 24 forms a molding cavity 27. A sand frame 25 is mounted onto the molding box 24, which sand frame makes filling in of the molding sand easier.

A lifting and supporting device is arranged below the table 9 on the rotary-table system 3. The device includes a lifting piston 12, which is connected to a piston rod 11, which in turn is fastened on the table 9. The lifting piston 12 is designed in the form of a double-acting piston and is movable in a lifting cylinder 10, the lower area of which has a support piston 13. By pressurizing the work chamber below the lifting piston 12, the support piston 13 of the lifting cylinder 10, which is supported on the rotary-table system 3 and is movable relative to the system, is moved downwardly until it rests on a support plate 26 of the frame 1. Furthermore, this pressurization causes the lifting piston 12 and thus also of the table 9 to be moved upwardly so that the sand frame 25 is pressed against a compressing device constructed at the upper area of the frame 1. The compressing device will be described in detail hereinafter. In order to prevent rotation of the table 9, the table has at least one table-guiding rod 14 movable in a recess of the rotary-table system 3.

The compressing device includes a pressing box 15 having a recess in which is arranged a pressing plate 16. The recess of the pressing box 15 is adapted to the size of the sand frame 25 or of the molding box 24. A pressure frame 20 can in addition be arranged on the underside of the pressing box, as this is illustrated in FIG. 1. The underside of the pressure frame 20 has a pressure seal 21 which, when the sand frame 25 rests against the pressure frame 20, guarantees an air-tight seal.

The pressure frame 15 is fixedly connected to the frame 1 and has an air inlet 19 through which pressure air can be pressed into the inside 28 of the pressing box 15 and thus into the molding cavity 27.

The pressing plate 16 is connected to a pressing piston 35 movable in a pressing cylinder 17 and designed as a double-acting piston. It is thus possible to lower or rather to lift the pressing plate. To prevent the pressing plate 16 from rotating, same is connected to a guide rod 18 which is movably guided in a recess in the frame or rather in the pressing box 15.

The above-described compressing device thus facilitates the use of an air-flow press molding method.

A lifting device is provided on the rotary-table system 3 in the area below each table 9, which lifting device includes a lifting cylinder 4, a lifting traverse 5 connected to same and lifting guide rods 6 connected to the lifting traverse 5. Thus, it is possible by operating the lifting cylinder 4 to lower or rather to lift the lifting traverse 5 and thus the guide rods 6. Each support 7 is releasably fastened to the upper ends of the guide rods 6 with a lifting pin 8 being supported on the support 7. By adjusting the position of the supports 7, it is possible to adapt the lifting device to the respective shape and design of the molding boxes 24 or rather of the sand frames 25.

The piston connected to the lifting traverse 5 through the piston rod 34 enables a precision controlled lifting off of the finished mold or rather of the molding box 24 from the pattern plate 22.

The rotary-table system 3 can in smaller molding machines be swivelled manually, however, it is also possible to provide an auxiliary drive to swivel the rotary-table system 3. Furthermore, it is possible to provide locking devices in order to guarantee an exact positioning of the table 9 in each case. Since the piston 12 is designed as a double-acting piston, it is assured, in the position ready for swivelling and shown in FIG. 1, that the support piston 13 does not rest against the support plate 26 so that a free swivelling of the rotary-table system 3 is possible.

By means of the molding machine of the invention, it is now possible to lift off a filled molding box 24 in the area of the lifting station identified by the reference numeral 31 and to replace the molding box with an empty molding box. Furthermore, it is possible to supply molding sand to the lifting station, for example from the service side 29. While these operations are taking place, it is possible to suitably compress the molding sand in the area of the compressing side.

Figure 2:
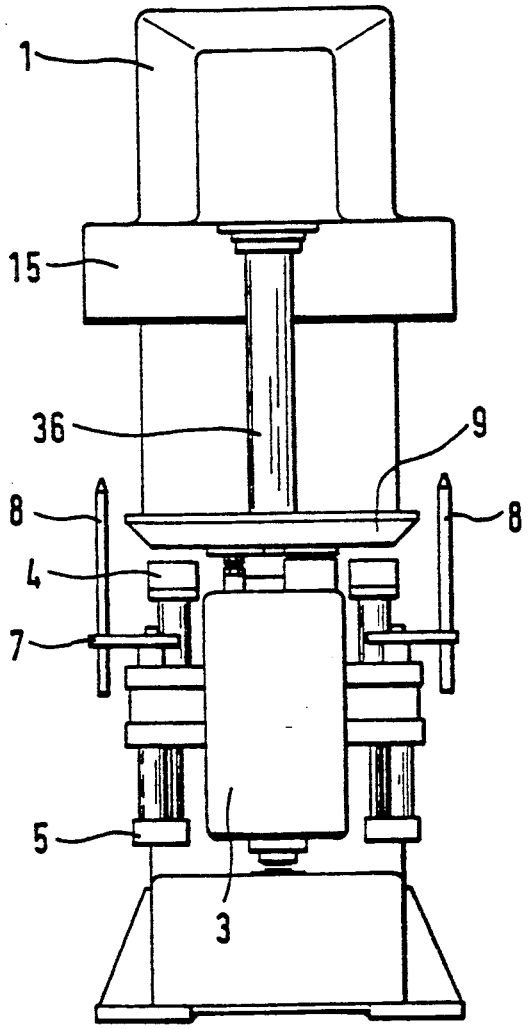
FIG. 2 is a front view of the molding machine illustrated in FIG. 1.

FIG. 2 illustrates a front view of the molding machine shown in FIG. 1, however, the molding box and the sand frame are not shown.

Figure 3:
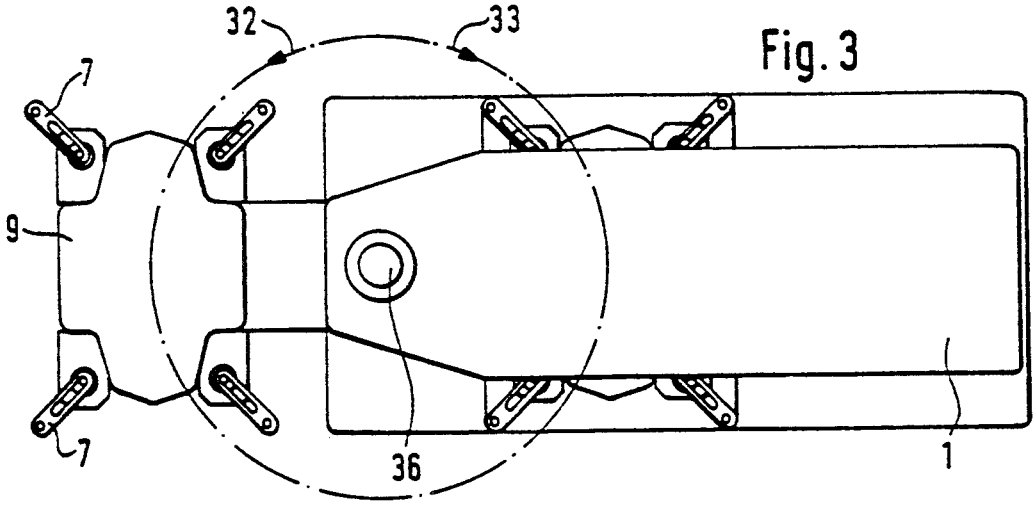
FIG. 3 is a top view of the molding machine illustrated in FIG. 1.

FIG. 3 is a top view of the molding machine of the invention with the molding machine also not being provided with a molding box or rather a sand frame. The arrows 32 and 33 characterize the swivelling capability of the rotary-table system 3.

The mold cavity in the air-flow press molding method usable according to the invention and thus the molding sand provided in the cavity are pre-compressed by introducing compressed air through the air inlet 19. The pressing box cavity 28 is subsequently ventilated through the air inlet 19 after which the pressing plate 16 is pulled back by the piston 35.

However, it is also possible according to the invention to use a different compressing method in a molding machine.

The invention is not to be limited to the illustrated exemplary embodiment, rather many possibilities for modifications result within the frame of the invention.

The embodiments of the invention in which an exclusive property or privilege is claimed are defined as follows:

I claim:

1. In a molding machine comprising a frame having spaced first and second frame parts, a compressing device mounted on the first frame part, a rotary-table system mounted on the second frame part and supported for rotation about an axle, which rotary-table system includes at least two tables and a lifting device for independently supporting each table for movement toward and away from the first frame part and the compressing device thereon, the improvement wherein a first support device is provided on the rotary-table system for a molding box adapted to hold moldable contents therein, wherein a second support device includes a support piston extendable from the rotary-table system to rest against the second frame part, and wherein the lifting device includes a lifting piston on which is supported the table, the lifting piston urging the table toward the compressing device when the support piston rests against the second frame part to compress the contents in the mold box oriented therebetween and to isolate the compressive forces applied to the contents in the mold box from the axle.

2. The molding machine according to claim 1, wherein the support piston includes a pipe-shaped lifting cylinder movable with respect to the table, in said lifting cylinder is arranged the lifting piston which is designed in a form of a double-acting piston having a reciprocal piston rod therein, the piston rod of the lifting piston being connected to the table.

3. The molding machine according to claim 1, wherein the table is connected to a table-guiding rod, which is movable in a recess of the rotary-table system.

4. The molding machine according to claim 1, wherein the first support device includes a lifting cylinder supported on the table on the rotary-table system and a piston rod cooperating with said lifting cylinder and being connected to lifting pins through a lifting traverse connected to said piston rod, the lifting pins resting against and supporting the molding box on the rotary-table system.

5. The molding machine according to claim 4, wherein the first support device further includes lifting guide rods being supported on the lifting traverse and support members, each of said support members carrying the lifting pin and being fastened to a free end of each of said lifting guide rods.

6. The molding machine according to claim 1, wherein the frame is designed substantially C-shaped in the side view, wherein the axle for the rotary-table system is vertically oriented, and wherein the rotary-table system includes two tables.

7. The molding machine according to claim 1, wherein a combination and lifting station is arranged on an outer area of the frame.

8. The molding machine according to claim 1, wherein the compressing device includes a pressing plate which is movably arranged inside of a pressing box pressurizable with pressure air.

9. The molding machine according to claim 8, wherein the pressing plate is connected to a double-acting pressing piston and a guide rod guided in the frame.

10. The molding machine according to claim 1, wherein the compressing device includes a pressure-shaking device.

* * * * *